United States Patent [19]

Litzler

[11] Patent Number: 5,024,331

[45] Date of Patent: Jun. 18, 1991

[54] PACKING WRAPPER FOR PACKAGING PASTY PRODUCTS AND PASTY PRODUCT PACKAGED THEREWITH

[75] Inventor: Jean Litzler, Heimsbrunn, France

[73] Assignee: Fromageries Bel, Paris, France

[21] Appl. No.: 343,137

[22] Filed: Apr. 26, 1989

[30] Foreign Application Priority Data

Apr. 26, 1988 [FR] France ..... 88 05527

[51] Int. Cl.[5] ..... B65D 65/34; B65D 85/76

[52] U.S. Cl. ..... 206/551; 206/606; 206/616

[58] Field of Search ..... 206/605, 606, 607, 610, 206/613, 616, 618, 551; 229/DIG. 9

[56] References Cited

U.S. PATENT DOCUMENTS

| | | | |
|---|---|---|---|
| 1,882,133 | 10/1932 | Fischer | 229/DIG. 9 |
| 2,517,801 | 8/1950 | Roush . | |
| 2,606,655 | 8/1952 | Rosen . | |
| 3,680,764 | 8/1972 | Young et al. | 206/607 |
| 4,072,263 | 2/1978 | Focke | 229/DIG. 9 |
| 4,801,075 | 1/1989 | Weber et al. | 206/551 |

FOREIGN PATENT DOCUMENTS

| | | | |
|---|---|---|---|
| 242268 | 10/1987 | European Pat. Off. | 206/551 |
| 2014398 | 5/1971 | Fed. Rep. of Germany . | |
| 2362765 | 3/1978 | France . | |
| 584632 | 2/1977 | Switzerland . | |
| 652370 | 11/1985 | Switzerland | 206/551 |
| 774063 | 5/1957 | United Kingdom . | |

*Primary Examiner*—Steven N. Meyers
*Assistant Examiner*—Jacob K. Ackun, Jr.
*Attorney, Agent, or Firm*—Young & Thompson

[57] ABSTRACT

A packing wrapper for packaging pasty products of parallelepipedic form. The wrapper comprises a foldable foil forming five faces (12) with dimensions substantially equal to the faces of the parallelepiped, and an opening device (18) for opening the packing wrapper by tearing it. The device consists in a foil of foldable material having an active portion (22) consisting in a single strip of a constant width substantially equal to that of one face (12) with parallel longitudinal outer edges arranged substantially along the sides of at least one face (12) to be torn; a tongue (20) of reduced width, defined by two parallel longitudinal edges, integral with the active portion (22), disposed at one end of the single strip and forming a grasping portion extending beyond the wrapper; and a central cutout (24), the profile of which matches that of the tongue, disposed at the other end of the active portion.

6 Claims, 2 Drawing Sheets

FIG_1
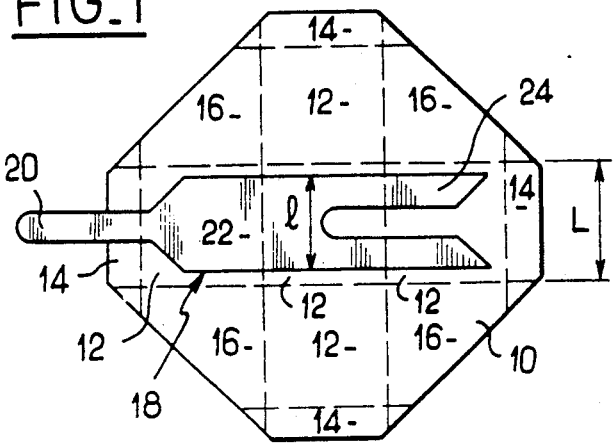
FIG_2B
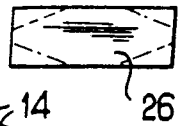
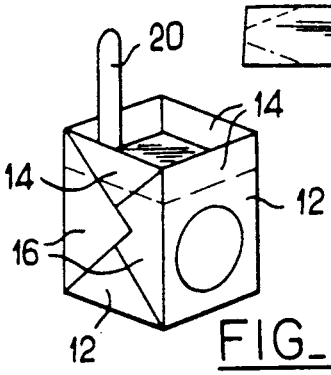
FIG_2A
FIG_3
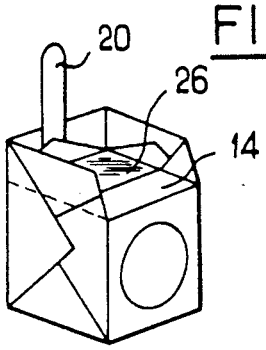
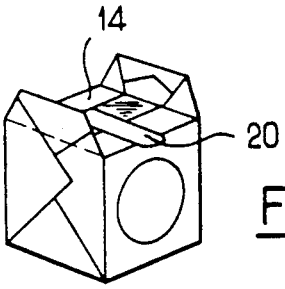
FIG_4
FIG_5
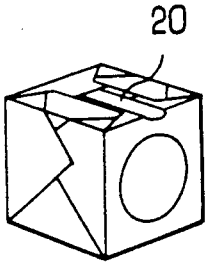
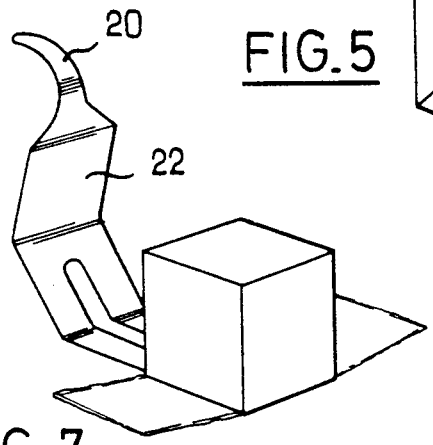
FIG_7
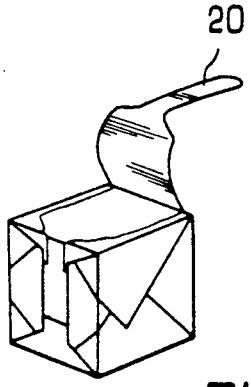
FIG_6
FIG_8
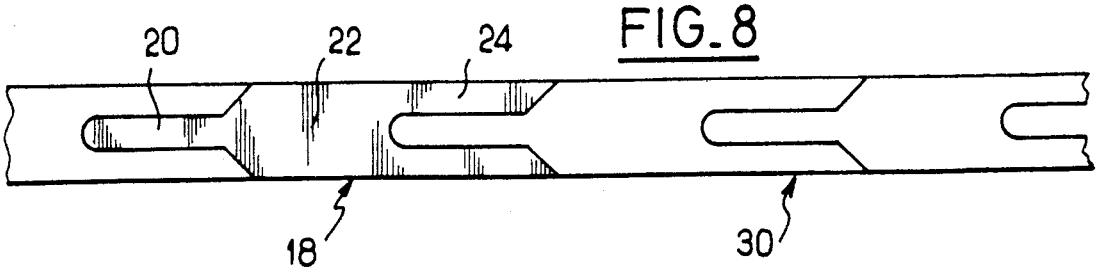

PACKING WRAPPER FOR PACKAGING PASTY PRODUCTS AND PASTY PRODUCT PACKAGED THEREWITH

The present invention relates to a packing wrapper for packaging pasty products, and to a pasty product packaged therewith.

There are known packs of the type opened by tearing a tearable sheet by means of a fork-shaped device composed of at least one cutout strip.

This type of pack comprises a first sheet which, by being folded, makes it possible to package a pasty product. In the example described in French patent application no. 2,362,765, the packaging is of the parallelepipedic type and the sheet makes it possible to package the pasty product, itself of parallelepipedic form, on five of its faces. Placed on the sixth face is a sheet of dimensions corresponding to those of the face on which it is to be arranged, whilst the parts of the first sheet which project above the faces adjacent to the sixth face are folded so as to obtain a sealed packaging.

In this same French patent application, the fork-shaped device is composed of two strips cut out in the form of S and of small width. These strips are arranged parallel to the edges of one and the same face, and their free ends are welded in order to form a grasping means.

These two cutout strips are located between the pasty product and the wrapper, and they are extended along three consecutive faces in the example described in this patent application. In contrast, the welded ends remain accessible on the outside of the pack.

Thus, the user, by pulling on the welded ends, initiates the tearing of the packaging wrapper on a first face, the wrapper tearing along the edges of the parallelepiped and therefore along the edge of its component faces on three consecutive faces.

Such a pack thus solves a first problem presented by this type of packaging, namely complete opening preventing some of the pasty product from remaining in the corners of the pack after opening, thus causing a loss of product.

Nevertheless, such a technical solution solves the particular problems only partially. In fact, the user will have to act relatively carefully to ensure that the two S-shaped strips do not come apart from one another at their end, thus giving rise to a pull on only one of these two strips and therefore an incorrect opening. Moreover, when the user exerts a pull on the end of these two strips, these tend to come nearer to one another because the wrapper forming the pack does not have sufficient rigidity to maintain the distance between these two strips, and this again can lead to an incorrect opening of this pack.

Furthermore, this pack has serious disadvantages in terms of production. On the one hand, putting the S-shaped strips, once cut out, in place on the wrapper which is to form the pack is a difficult operation because of the size of these strips and their special shapes. On the other hand, the positioning of these same strips on the pack must be very exact so that the two strips can perform their function as a tearing device simultaneously.

Finally, the free ends of the two strips of the pack are thermally welded so as to form a grasping means. Such an operation is likewise difficult and is added to the many prior operations.

Such packs are intended for the packaging of pasty products especially soft cheeses to form portions of low weight. The cost of such a pack must therefore be low so as not to represent too high a fraction of the final cost price. It must also be pointed out that, because of the very large product quantities produced, reliability is a factor of great importance, this being the reason why the manufacturers seek packs which are easy to put into effect and which can be processed by simple machines.

The object of the invention is, therefore, to provide a packaging wrapper of a pasty product that opens by tearing, which mitigates the disadvantages of known packs, whilst at the same time being economical to produce, easy to put into effect by the manufacturer and convenient to use.

Another object of the invention is to provide a pasty product packaged in such a packaging wrapper.

The device for opening a packaging wrapper of a pasty product of parallelepipedic form by tearing, arranged between this wrapper and this pasty product and comprising a grasping means accessible from outside and an active portion, of which the parallel longitudinal outer edges are arranged substantially along the sides of at least one face to be torn, is characterized essentially in that the active portion is a single strip, the width of which is substantially equal to that of the said face, this strip having, at one of its ends, a tongue of reduced width, integral with the active portion and forming the grasping means, and, at its other end, a central cutout, the profile of which matches that of the tongue.

The present invention will be understood better from a reading of the description of a particular embodiment, with reference to the accompanying Figures in which:

FIG. 1 shows the packaging wrapper with its device for opening by tearing, before folding;

FIG. 2*a* shows the wrapper of FIG. 1, once folded and containing the pasty product before the additional wrapper shown in FIG. 2*b* is put in place;

FIG. 3 shows the folded wrapper with the additional wrapper in place, before the tongue is turned down;

FIG. 4 shows the last step but one, during which the flap carrying the tongue is folded down.

FIG. 5 shows the last step during which the last flaps are folded down.

FIG. 6 shows the first step of opening by tearing by means of the device according to the invention;

FIG. 7 shows the complete opening by tearing of the packaging wrapper by means of the device according to the invention;

FIG. 8 shows the devices for opening by tearing according to the invention, as they appear during their production;

Figure 9:
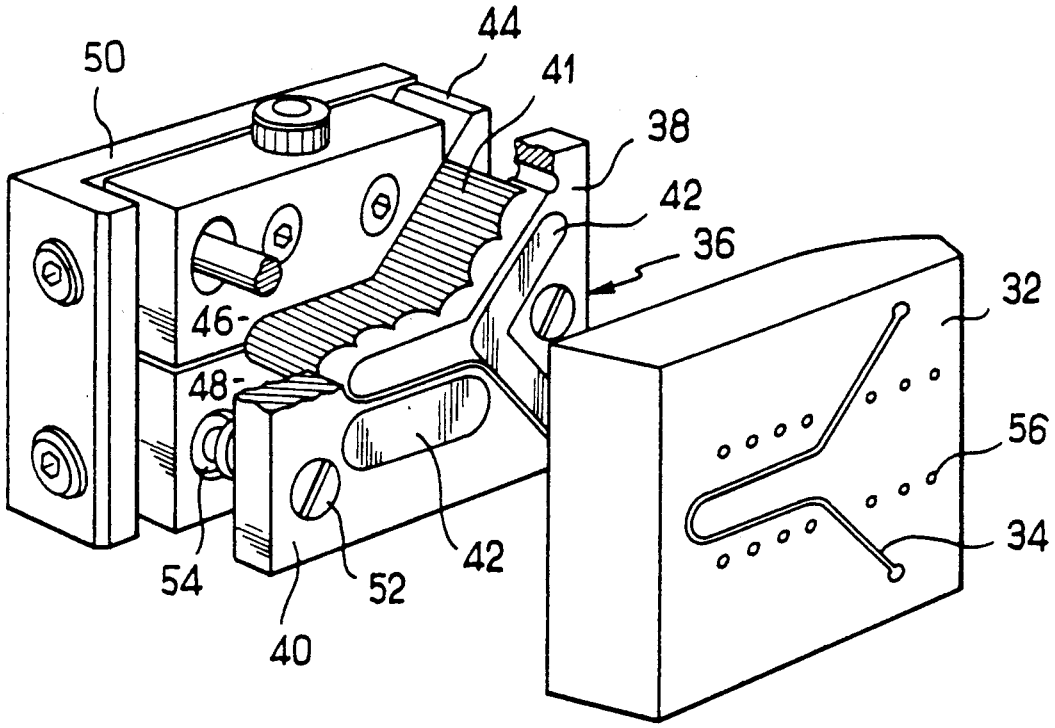
FIG. 9 shows a cutting-out appliance making it possible to produce the devices according to the invention for the opening of a packaging wrapper by tearing.

FIG. 1 shows the packaging wrapper 10 in an octagonal form, in which there are five faces 12, flaps 14 and foldable parts 16 ensuring the sealing of the pack. Moreover, there is a device 18 for opening this packaging wrapper by tearing, which comprises a grasping means in the form of a tongue 20, an active portion 22 consisting of a single strip, the width 1 of which is potentially equal to the width L of a face 12, and a cutout part 24, which is located at the end opposite that carrying the tongue and the profile of which matches that of this same tongue.

The tongue 20 is connected to the packaging wrapper by any known means, especially by thermal welding.

In the embodiment illustrated, the faces 12 are squares, in order, once folded, to generate a cube open on its upper face. The pasty product is then poured directly into this packaging wrapper until the cube is filled; an additional wrapper 26 is then arranged on the open face of the product, in such a way that the sides of this additional wrapper 26 form an angle of 45° with the angles of the upper face of the cube.

FIG. 4 shows the last step but one, during which the flap carrying the tongue is folded down, at the end of the latter 20 coming to rest on top of the opposite flap.

FIG. 5 shows the last step, during which the last flaps are folded down.

The pasty product is thus packaged in a completely closed wrapper, with the tearing device 18 interposed between this wrapper and this pasty product, whilst leaving the grasping tongue accessible from outside.

FIG. 6 shows the opening by tearing of the packaging wrapper by means of the device according to the invention.

In fact, a pull on the tongue 20 makes it possible to tear the wrapper substantially along its edges, because the active part is sufficiently rigid to cause the wrapper to be torn substantially along the parallel edges of a first face, this tearing continuing on a second consecutive face, once the tearing of the wrapper has been correctly initiated, thereafter continuing on a third face, as shown in FIG. 7. Moreover, this Figure shows the additional steps making it possible to expose the pasty product completely involving spreading the two remaining faces apart after they have been cut, the pasty product then resting only on the flaps and on the additional wrapper 26. The pasty product is thus immediately accessible.

FIG. 8 shows the device 18 for opening by tearing during its production from a strip 30. It shows once again the tongue 20, the active part 22 and the end part 24. It can be seen that there is therefore no loss during the production of these devices and that, furthermore, they can be handled easily. Moreover, its rigidity is improved by the presence of the active part 22. It is easy to adapt the form of the devices to the particular packs since it is sufficient to change the width of the strip and the shape of the cutting-out punch.

For this purpose, the invention also provides an appliance making it possible to cut out the strips 30 so as to form tearing devices 18.

Such an appliance comprises a die 32 possessing an open slit 34 having a profile suitable for simultaneously cutting out the rear part of a first tearing device and the front part of the next device.

In this particular case, the form is substantially that of the tongue 20 and the front portion of the active part 22.

A clamp 36 keeps the strip 30 laid against the die 32 during the cutting-out operation. This clamp comprises two parts 38 and 40, between which the cutting blade 41 can slide. The two component parts 38 and 40 of the clamp are also equipped with pads of elastomeric material 42, making it possible to lay the strip on the die 32. The cutting blade 41 is of the flexible type and, in order to match the profile of the slit 34, is shaped by means of three clamping blocks 44, 46, 48, themselves held by means of a support 50.

The clamp 36 is mounted moveably relative to these same blocks 44 to 48 and relative to the support 50 by means of screws 52, round which compression springs 54 are arranged.

Such an appliance functions as follows: the strip is moved along between the die 32 and the clamp 36 by any known means, the clamp is then laid against the strip which is itself laid against the die as soon as the translational motion of this same strip stops, and the support 50 is shifted so that the cutting blade 40 passes through the clamp 36 and through the slit 34 of the die 32, thus cutting the strip to the exact profile of the tearing device. So that the strip is laid perfectly against the die, there can be communication bores 56 between the two faces of the die 32. Once the support 50 has been shifted in the opposite direction, the blade retracts within the clamp, and after the latter has been released from the die the strip is free and can once again be moved in translational motion. To make this last movement easier, moreover, the cutout is such that a connection remains between the two parts which have just been cut out by the blade.

I claim:

1. A packing wrapper for packaging pasty products of parallelepipedic form, said wrapper comprising a foldable foil forming five faces (12) with dimensions substantially equal to the faces of the parallelepiped, and an opening device (18) for opening said packing wrapper by tearing said packing wrapper, said device consisting in a foil of foldable material, wherein said opening device comprises:

an active portion (22) consisting in a single strip of a constant width extending over three consecutive said faces (12) with parallel longitudinal outer edges arranged substantially along the sides of three consecutive said faces (12) to be torn;

a tongue (20) of reduced width, defined by two parallel longitudinal edges and a terminal edge, integral with said active portion (22), disposed at one end of the single strip and forming a grasping means extending beyond the wrapper and accessible from the outside; and a central cutout (24), the profile of which matches that of the entire tongue and is defined by two parallel longitudinal edges and a terminal edge, disposed at the other end of said active portion.

2. A packing wrapper according to claim 1, wherein the opening device (18) is thermally welded to the packing wrapper.

3. A packing wrapper according to claim 1, wherein the opening device (18) is cut from a continuous strip.

4. A packing wrapper according to claim 1, which is octagonal.

5. A packaged pasty product of parallelepipedic form comprising:

a pasty product of parallelepipedic form, a packing wrapper comprising a foldable foil forming five faces (12) with dimensions substantially equal to the faces of the parallelepiped, and an opening device (18) for opening said packaging wrapper by tearing said packing wrapper, said device being disposed between the wrapper and the pasty product and consisting in a foil of foldable material, said opening device comprising:

an active portion (22) consisting in a single strip of a constant width extending over three consecutive said faces (12) with parallel longitudinal outer edges arranged substantially along the sides of three consecutive said faces (12) to be torn;

a tongue (30) of reduced width, defined by two parallel longitudinal edges and a terminal edge, integral with the active portion (22), disposed at one end of the single strip and forming a grasping means extending beyond the wrapper and accessible from the outside; and a central cutout (24), the profile of which matches that of the entire tongue and is defined by two parallel longitudinal edges and a terminal edge, disposed at the other end of said active portion, the packing wrapper being folded about the pasty product so as to generate a parallelepiped open on one face, and an additional wrapper (26) covering said opening face.

6. A packaged pasty product according to claim 5, having the form of a cube.

* * * * *